US005352406A

United States Patent [19]

Barteri et al.

[11] Patent Number: 5,352,406

[45] Date of Patent: Oct. 4, 1994

[54] HIGHLY MECHANICAL AND CORROSION RESISTANT STAINLESS STEEL AND RELEVANT TREATMENT PROCESS

[75] Inventors: Massimo Barteri, Rome; Ivan Nembrini, Montello, both of Italy

[73] Assignees: Centro Sviluppo Materiali S.p.A., Rome; Dalmine S.p.A., Dalmine, both of Italy

[21] Appl. No.: 51,424

[22] Filed: Apr. 23, 1993

[51] Int. Cl.[5] ..... C22C 38/44; C22C 38/20; C21D 8/10; C21D 8/00

[52] U.S. Cl. ..... 420/49; 420/45; 420/58; 138/177; 148/592; 148/597; 148/325; 148/327

[58] Field of Search ..... 148/592, 597, 654, 325, 148/327; 138/177, DIG. 6; 420/49, 45, 58

[56] References Cited

U.S. PATENT DOCUMENTS 4,604,887 8/1986 Ohtsubo et al. .
4,915,752 4/1990 Culling ..... 148/327
5,049,210 9/1991 Miyasaka et al. ..... 148/592
5,240,516 8/1993 Iseda et al. ..... 148/325

FOREIGN PATENT DOCUMENTS

0220141A2 4/1987 European Pat. Off. .
0360143A1 3/1990 European Pat. Off. .
0534864A1 3/1993 European Pat. Off. .
0545753A1 9/1993 European Pat. Off. .
0566814A1 10/1993 European Pat. Off. .
2133037A1 7/1984 United Kingdom .
2160221A 12/1985 United Kingdom .
2203680A 10/1988 United Kingdom .

*Primary Examiner*—Deborah Yee
*Attorney, Agent, or Firm*—Oliff & Berridge

[57] ABSTRACT

A properly balanced chemical composition and the choice of a heat treatment (annealing and quenching) under controlled conditions allow to obtain uperduplex stainless steel manufactures which, in the hot-worked form, are excellent in resistance to corrosion and have unit tensile yield strength at room temperature of 90 ksi min.

25 Claims, No Drawings

HIGHLY MECHANICAL AND CORROSION RESISTANT STAINLESS STEEL AND RELEVANT TREATMENT PROCESS

FIELD OF THE INVENTION

The present invention refers to a highly mechanical and corrosion resistant stainless steel and the relevant treatment process.

The invention also refers to the manufactures made of the aforesaid stainless steel.

PRIOR ART

Stainless steels have extensive application in the oil wells drill pipes sector, which requires steel types with adequate mechanical and corrosion resistance. However, the growing exploitation of hydrocarbon fields of acid—or sour—type, named so being high in hydrogen sulphide and/or carbon dioxide and often also in chloride, makes the choice of suitable materials extremely hard.

Therefore, in an attempt to prevent any possible accident, such as deep pipe piercing, oil companies fixed very stringent standards for said materials.

The most suited steels for use in the aforementioned sour fields are biphasic type, e.g. superduplex type. The on-grade composition (% by wt.) of some of them is reported below:

UNS S32750: C≦0.03, Cr 24–26, Ni 6–8, Mo 3–5, N 0.24–0.32, Mn≦1.2, P≦0.035, S≦0.02, Si≦0.8;

UNS S32550: C≦0.04, Cr 24–27, Ni 4.5–6.5, Mo 2–4, Cu 1.5–2.5, N 0.1–0.25, Mn≦1.5, P≦0.04, S≦0.03, Si≦1;

UNS S32760: C≦0.03, Cr 24–26, Ni 6–8, Mo 3–4, W 0.5–1, Cu 0.5–1, N<0.03, Mn≦1, P≦0.03, S≦0.01, Si≦1

Notwithstanding the apparent similarity of compositions, the properties of the above steels are different, e.g.:

UNS S32750: due to its high nitrogen content, it shows an increased pitting resistance and an increased mechanical resistance by solid solution hardening;

UNS S32760: due to its lower nitrogen content, it is less subject to vulnerability caused by the formation of chromium nitrides. The lower nitrogen contribution to the pitting resistance is compensated by the presence of tungsten in the alloy;

UNS S32550 has a nitrogen content similar to that of UNS S32760 and does not contain tungsten. However, the presence of copper increases its corrosion resistance in reducing acid media.

The aforementioned steels show minimum guaranteed unit tensile yield strength values of approx. 65–80 ksi max., which values make them inadequate to use in the fast expanding sour-type deep wells.

Better mechanical properties can be obtained only by cold-rolling; this treatment, however, causes a considerable increase in the costs of the material and a decrease in its resistance to corrosion and stress corrosion.

To conclude, no superduplex stainless steel known so far is capable of meeting the mechanical resistance requirements deeper wells and the corrosion and stress corrosion resistance requirements involved by the use in ever more aggressive media. It has now been found an alloy consisting of conveniently selected and well balanced elements capable of solving the problems mentioned above. The alloy complies with oil companies' stringent and exacting regulations governing steel compositions.

SUMMARY

It is an object of the present invention to obtain a steel alloy.

A further object of the present invention is the use of said alloy for producing highly mechanical, corrosion and stress corrosion resistant manufactures in the solubilized hot-extruded or rolled form.

It is a further object of the present invention to provide manufactures constructed of said alloy, preferably pipes, and more preferably seamless pipes.

A further object of the present invention is the heat treatment, i.e. annealing and quenching, the said manufactures are subjected to to reach minimum guaranteed unit tensile yield strength values of about 90 ksi or higher.

Further objects of the present invention will become apparent from the detailed description thereof.

DETAILED DESCRIPTION OF THE INVENTION

The alloy according to the present invention is characterized by the following composition (% by wt.):

C≦0.03, Cr 24.5–27, Ni 6.5–9, Mo 3.5–4.5, W 0.7–2.5; Cu 1.5–2.5, N 0.25–0.30, Mn≦1, P≦0.03, S≦0.005, Si≦1 balance iron and trace impurities.

The following composition range is preferred:

C≦0.025, Cr 24.5–26, Ni 7–8, Mo 3.8–4.2, W 0.8–1.2, Cu 1.5–2.0, N 0.25–0.30, Mn 0.5–0.7, P≦0.03, S≦0.003, Si≦0.7 balance iron and trace impurities.

The alloy according to the invention is characterized by the presence of W and Cu in the amounts and ranges as defined above and by the combination of same with Cr, Ni, Mo, and N.

Adequate alloying and heat treatment give highly mechanical and corrosion resistant products well suited to use in sour-type deep wells.

It is therefore possible to obtain superduplex stainless steel manufactures, in particular seamless pipes, which in the solubilized hot-worked form show high mechanical, corrosion and stress corrosion resistance properties.

The claimed procedure consists of the concurrent combination of the steps of:

preparing an ingot having the following composition (% by wt.):

C≦0.03, Cr 24.5–27, Ni 6.5–9, Mo 3.5–4.5, W 0.7–2.5, Cu 1.5– 2.5, N 0.25–0.30, Mn≦1, P≦0.03, S≦0.005, Si≦1 balance iron and trace impurities;

first hot-working of same by traditional techniques, such as forging or rolling, to obtain a semimanufactured product;

heating of the semimanufactured product to a temperature of 1100° C. to 1260° C. and further hot-working of same by extrusion to obtain a manufacture, e.g. seamless pipes, in the desired final shape and size, which is quenched in water from a temperature higher than 950° C.;

annealing the product at a temperature between 1050° C. and 1200° C. for 1 to 30 minutes, and quenching in water to obtain and stabilize a biphasic ferrite and austenite structure with ferrite fraction of 0.4 to 0.6 by vol. The following work conditions are preferred: casting into ingots, forging into rods 130–250 mm in diameter, followed by annealing at a temperature of 1180° C. to 1240° C., hot-working by extrusion or by rolling and quenching in water from a temperature of 1050° C. to 1150° C., final annealing at a temperature of 1090° C. to 1190° C., for 5 to 25 minutes, and quenching in water from a temperature of 1050° C. min.

The various steps of the claimed procedure are adequately combined to obtain an alloy having the desired characteristics. The mechanical properties were probably improved by a synergistic effect produced by solid solution hardening caused by copper and tungsten, and enhanced by the particular thermomechanical cycle adopted.

The heat treatment, i.e. solubilization and balancing of phases, at 1050° C. to 1190° C. for 1 to 30 min. allows to obtain a structure containing a ferrite and an austenite fraction, each being 0.4 to 0.6 by vol.

The manufactures produced according to the claimed procedure, after solubilization annealing, showed a unit tensile yield strength at room temperature of 90 ksi min., preferably of 90 to 110 ksi, which value decreases by 15% at 130° C.

The manufactures as for the present invention show a much higher stress corrosion resistance than the traditional stainless steels meant for the same applications: therefore, the claimed manufacture and in particular seamless pipes can be used in highly aggressive media.

The material produced was subjected to slow strength rate test (SSRT) in an aggressive medium and proved to be free from stress corrosion and pitting at high temperatures.

In particular, corrosion phenomena did not occur at 80° C. in 100 g/l sodium chloride solutions in the presence of a gas phase containing carbon dioxide at a partial pressure of 40 bar min. and sulphuric acid at a partial pressure of 0.30 bar max.: at 110° C. in media containing hydrogen sulphide at a partial pressure of 0.35 bar max., carbon dioxide at a partial pressure of about 40 bar min., and sodium chloride of about 50 g/l; at 180° C., i.e. at the characteristic temperature of very deep wells, in media containing carbon dioxide at a partial pressure of 40 bar min. and hydrogen sulphide at 0.30 bar max., in the presence of sodium chloride at a concentration of 200 g/l max.

The following example illustrates the claimed invention. The example is illustrative only and is not to be regarded as limiting the scope of the invention.

EXAMPLE

Steels having the following composition (% by wt.) were prepared:

Ref 1: C 0.017, Cr 25.59, Ni 7.30, Mo 3.88, W 1.00, Cu 1.72, N 0.272, Mn 0.53, P 0.021, S 0.001, Si 0.54.

Ref 2: C 0.025, Cr 26.86, Ni 7.05, Mo 4.23, W 1.18, Cu 1.55, N 0.258, Mn 0.61, P 0.021, S 0.0016, Si 0.88.

Ref 3: C 0.020, Cr 25.07, Ni 7.63, Mo 4.02, W 0.87, Cu 1.85, N 0.288, Mn 0.55, P 0.024, S 0.002, Si 0.70.

and treated as follows: casting into ingots, forging into rods 180 mm in diameter, followed by heating to 1190° C. and extrusion to form a pipe 88.9 mm in diameter and 6.45 mm in thickness, quenching in water from a temperature of 1060° C., final solubilization annealing at 1160° C. for 12 minutes, and quenching in water from a temperature of 1050° C.

The steel under Ref 2 underwent, by way of comparison, a different treatment, characterized by different solubilization annealing conditions (1240° C. for 5 minutes), followed by quenching in water from a temperature of 900° C.; said steel will be referred to as Ref 2a.

The manufactures obtained were subjected to tests according to API standards, 5CT sect 52 and 53 for mechanical properties checking and to SSRT in an aggressive medium consisting of a 200 g/l NaCl aqueous solution at 80° C., saturated with $H_2S$ at a partial pressure of 100 mbar.

Test comparison gave some parameters, the most significant being the ductility ratio (ELR), i.e. the ratio of the elongation at break in an aggressive medium to the elongation at break in an inert medium (oil). At ELR of 0.90 min., the material is considered free from stress corrosion.

The presence, if any, of secondary cracks (SCC) was also checked at the end of the test.

Likewise, tests were conducted on known steels of the aforesaid types in accordance with UNS code, having the following compositions (% by wt.):

750: C 0.022, Cr 25.48, Ni 7.04, Mo 3.58, Cu 0.12, N 0.257, Mn 0.84, P 0.024, S 0.001, Si 0.45

550: C 0.020, Cr 25.20, Ni 6.48, Mo 3.46, Cu 1.64, N 0.240, Mn 1.26, P 0.020, S 0.001, Si 0.66

760: C 0.016, Cr 25.22, Ni 7.36, Mo 3.17, W 0.70, Cu 0.62, N 0.220, Mn 0.70, P 0.023, S 0.002, Si 0.47.

The results obtained are shown in the following table:

| | Rp 0.2 ksi (MPa) | ELR | SCC |
|---|---|---|---|
| Ref 1 | 96 (661) | 0.99 | no |
| Ref 2 | 97 (668) | 0.97 | no |
| Ref 2a | 88 (606) | 0.74 | yes |
| Ref 3 | 94 (647) | 0.97 | no |
| UNS 750 | 82 (565) | 0.97 | no |
| UNS 550 | 82 (565) | 0.92 | no |
| UNS 760 | 78 (537) | 0.93 | no |

As may be seen, a particular alloy composition combined with an adequate thermomechanical cycle, according to the present invention, give products showing tensile yield strengths higher by at least 14.6% than the corresponding values of known products as well as excellent stress corrosion resistance values.

As proved by Ref 2a, the same results cannot be obtained if the heat treatment differed from the claimed one.

We claim:

1. Alloy having the following composition (% by wt.):

C≦0.03, Cr 24.5–27, Ni 6.5–9, Mo 3.5–4.5, W 0.7–2.5; Cu 1.5–2.5, N 0.25–0.30, Mn≦1, P≦0.03, S≦0.005, Si≦1, balance iron and trace impurities.

2. Alloy having the following composition (% by wt.): C≦0.025, Cr 24.5–26, Ni 7–8, Mo 3.8–4.2, W 0.8–1.2, Cu 1.5–2.0, N 0.25–0.30, Mn 0.5–0.7, P≦0.03, S≦0.003, Si≦0.7 balance iron and trace impurities.

3. Procedure for the production of manufactured articles comprising the concurrent combination of the steps of: (i) preparing an ingot having the following composition (% by wt.): C≦0.03, Cr 24.5–27, Ni 6.5–9, Mo 3.5–4.5, W 0.7–2.5, Cu 1.5–2.5, N 0.25–0.30, Mn≦1, P≦0.03, S≦0.005, Si≦1, the balance being iron and trace impurities; (ii) first hot-working said ingot to obtain a semimanufactured product; (iii) heating the semimanufactured product to a temperature of 1100° C. to 1260° C. and further hot-working the semimanufactured product by extrusion to obtain a manufactured article in the desired final shape and size, which is quenched in water from a temperature of 950° C. min.; (iv) annealing the manufactured article at a temperature between 1050° C. and 1200° C. for 1 to 30 minutes, and then quenching the manufactured article in water to obtain a biphasic ferrite and austenite structure with ferrite fraction of 40 to 60% by vol.

4. The procedure according to claim 3 wherein the first hot-working is carried out by techniques selected between forging and rolling.

5. Procedure for the production of manufactured articles comprising the concurrent combination of the steps of: preparing an ingot having the following composition (% by wt.): C≦0.03, Cr 24.5–27, Ni 6.5–9, Mo 3.5–4.5, W 0.7–2.5, Cu 1.5–2.5, N 0.25–0.30, Mn≦1, P≦0.03, S≦0.005, Si≦1, the balance being iron and trace impurities; forging into rods 130–250 mm in diameter, followed by annealing at a temperature of 1180° C. to 1240° C., hot-working by extrusion or by rolling and quenching in water from a temperature of 1050° C. to 1150° C., final annealing at a temperature of 1090° C. to 1190° C., for 5 to 25 minutes, and quenching in water from a temperature of 1050° C. min.

6. The procedure according to claim 3 wherein the ingot composition (% by wt.) is in the following range: C≦0.025, Cr 24.5–26, Ni 7.0–8.0, Mo 3.8–4.2, W 0.8–1.2, Cu 1.5–2.0, N 0.25 0.30, Mn 0.5–0.7, P≦0.03, S≦0.003, Si≦0.7.

7. The procedure according to claim 3 wherein the manufactured articles are seamless pipes.

8. Method for producing hot-worked metal articles comprising forming the articles from an alloy having the following composition (% by wt.): C≦0.03, Cr 24.5–27, Ni 6.5–9, Mo 3.5–4.5, W 0.7–2.5, Cu 1.5–2.5, N 0.25–0.30, Mn≦1, P≦0.03, S≦0.005, Si≦1, the balance being iron and trace impurities.

9. Method for producing hot-worked metal articles comprising forming the articles from an alloy having the following composition (% by wt.): C≦0.025, Cr 24.5–26, Ni 7–8, Mo 3.8–4.2, W 0.8–1.2, Cu 1.5–2.0, N 0.25–0.30, Mn 0.5–0.7, P≦0.03, S≦0.003, Si≦0.7 the balance being iron and trace impurities.

10. The method according to claim 8 wherein the articles are hot-worked by forging, rolling, extrusion and combinations thereof.

11. The method according to claim 8 wherein the articles are seamless pipes.

12. Manufactured articles having the following composition (% by wt.): C≦0.03, Cr 24.5–27, Ni 6.5–9, Mo 3.5–4.5, W 0.7–2.5; Cu 1.5–2.5, N 0.25–0.30, Mn≦1, P≦0.03, S≦0.005, Si≦1, the balance being iron and trace impurities.

13. Manufactured articles having the following composition (% by wt.): C≦0.025, Cr 24.5–26, Ni 7–8, Mo 3.8–4.2, W 0.8–1.2, Cu 1.5–2.0, N 0.25–0.30, Mn 0.5–0.7, P≦0.03, S≦0.003, Si≦0.7, the balance being iron and trace impurities.

14. The manufactured articles according to claim 12 having a yield strength at room temperature of 90 ksi min.

15. The manufactured articles according to claim 12 having a yield strength ranging between 90 ksi and 110 ksi at room temperature and decreasing by 15% at a temperature of 130° C.

16. The manufactured articles according to claim 12 wherein slow strength rate tests reveal no corrosion phenomena at 80° C. in 100 g/l sodium chloride solutions in the presence of a gas phase containing carbon dioxide at a partial pressure of 40 bar min. and sulphuric acid at a partial pressure of 0.30 bar max.

17. The manufactured articles according to claim 12 wherein slow strength rate tests reveal no corrosion phenomena at 110° C. in media containing hydrogen sulphide at a partial pressure of 0.35 bar max., carbon dioxide at a partial pressure in the order of 40 bar min., and sodium chloride in the order of 50 g/l.

18. The manufactured articles according to claim 12 wherein slow strength rate tests reveal no corrosion phenomena at 180° C., in media containing carbon dioxide at a partial pressure of 40 bar min. and hydrogen sulphide at 0.30 bar max., in the presence of sodium chloride at a concentration of 200 g/l max.

19. Seamless pipes having the following composition (% by wt.): C≦0.03, Cr 24.5–27, Ni 6.5–9, Mo 3.5–4.5, W 0.7–2.5; Cu 1.5–2.5, N 0.25–0.30, Mn≦1, P≦0.03, S≦0.005, Si≦1, the balance being iron and trace impurities.

20. Seamless pipes having the following composition (% by wt.): C≦0.025, Cr 24.5–26, Ni 7–8, Mo 3.8–4.2, W 0.8–1.2, Cu 1.5–2.0, N 0.25–0.30, Mn 0.5–0.7, P≦0.03, S≦0.003, Si≦0.7, the balance being iron and trace impurities.

21. The pipes according to claim 20 having a yield strength at room temperature of 90 ksi min.

22. The pipes according to claim 20 having a yield strength ranging between 90 and 110 ksi at room temperature and decreasing by 15% at a temperature of 130° C.

23. The pipes according to claim 20 wherein slow strength rate tests reveal no corrosion phenomena at 80° C. in 100 g/l sodium chloride solutions in the presence of a gas phase containing carbon dioxide at a partial pressure 40 bar min. and sulphuric acid at a partial pressure of 0.30 bar max.

24. The pipes according to claim 20 wherein slow strength rate tests reveal no corrosion phenomena at 110° C. in media containing hydrogen sulphide at a partial pressure of 0.35 bar max., carbon dioxide at a partial pressure in the order of 40 bar min., and sodium chloride in the order of 50 g/l.

25. The pipes according to claim 20 wherein slow strength rate tests reveal no corrosion phenomena at 180° C., in media containing carbon dioxide at a partial pressure of 40 bar min. and hydrogen sulphide at 0.30 bar max., in the presence of sodium chloride at a concentration of 200 g/l max.

* * * * *

UNITED STATES PATENT AND TRADEMARK OFFICE

CERTIFICATE OF CORRECTION

PATENT NO. : 5,352,406

DATED : October 4, 1994

INVENTOR(S) : Massimo Barteri and Ivan Nembrini

It is certified that error appears in the above-indentified patent and that said Letters Patent is hereby corrected as shown below:

On the cover page, please add:

[30] Foreign Application Priority Data

Oct. 27, 1992 Italian.....92-A 000782

Signed and Sealed this

Eighteenth Day of June, 1996

Bruce Lehman

*Attest:*

BRUCE LEHMAN

*Attesting Officer*

*Commissioner of Patents and Trademarks*